US009837055B2

(12) United States Patent
Muoio

(10) Patent No.: US 9,837,055 B2
(45) Date of Patent: Dec. 5, 2017

(54) HYBRID PLECTRUM

(71) Applicant: Stephen A. Muoio, Cross River, NY (US)

(72) Inventor: Stephen A. Muoio, Cross River, NY (US)

( * ) Notice: Subject to any disclaimer, the term of this patent is extended or adjusted under 35 U.S.C. 154(b) by 0 days.

(21) Appl. No.: 15/432,924

(22) Filed: Feb. 15, 2017

(65) Prior Publication Data

US 2017/0236501 A1 Aug. 17, 2017

Related U.S. Application Data

(60) Provisional application No. 62/296,375, filed on Feb. 17, 2016.

(51) Int. Cl.
*G10D 3/16* (2006.01)

(52) U.S. Cl.
CPC ..... *G10D 3/163* (2013.01)

(58) Field of Classification Search
CPC ..... G10D 3/08; G10D 3/163
USPC ..... 84/320–322
See application file for complete search history.

(56) References Cited

U.S. PATENT DOCUMENTS

| | | | | |
|---|---|---|---|---|
| 5,648,622 | A | 7/1997 | Storey | |
| 5,894,097 | A | 4/1999 | Barry | |
| 6,225,539 | B1 * | 5/2001 | Freeman | G10D 3/163 84/320 |
| 7,804,013 | B2 | 9/2010 | Rapaport | |
| 8,664,498 | B2 | 3/2014 | Leneman | |
| 9,418,632 | B2 | 8/2016 | Snyder | |
| 2004/0118265 | A1 | 6/2004 | Katz | |
| 2005/0211054 | A1 | 9/2005 | Rapaport | |
| 2006/0156895 | A1 | 7/2006 | Judd et al. | |
| 2013/0092008 | A1 | 4/2013 | Murphy | |
| 2015/0287394 | A1 | 10/2015 | Tsukada | |

FOREIGN PATENT DOCUMENTS

| | | | |
|---|---|---|---|
| CA | 2599266 | A1 | 3/2009 |
| WO | 2004038691 | A1 | 5/2004 |
| WO | 2014028728 | A1 | 2/2014 |
| WO | 2015134868 | A1 | 9/2015 |
| WO | 2016113700 | A1 | 7/2016 |

* cited by examiner

*Primary Examiner* — Kimberly Lockett
(74) *Attorney, Agent, or Firm* — Allen F. Bennett

(57) ABSTRACT

A plectrum for playing a stringed musical instrument includes a body with two opposing sides, a lower plucking region, a central gripping region and a top region having a transverse groove. A wedge shaped piece of material is secured into the transverse groove on the top of the plectrum to provide a second surface for impinging or actuating the strings of the instrument. Typically, the body of the plectrum is composed of a semi rigid or flexible plastic, while the wedge of material is composed of a harder substance, such as glass or polished stone.

6 Claims, 3 Drawing Sheets

HYBRID PLECTRUM

CROSS-REFERENCE TO RELATED APPLICATIONS

This application claims priority to U.S. Provisional Application Ser. No. 62/296,375 filed on Feb. 17, 2016, the contents of which are hereby incorporated in their entirety.

STATEMENT REGARDING FEDERALLY SPONSORED RESEARCH OR DEVELOPMENT

Not Applicable.

NAMES OF PARTIES TO A JOINT RESEARCH AGREEMENT

Not Applicable

REFERENCE TO SEQUENCE LISTING, A TABLE, OR A COMPUTER PROGRAM LISTING APPENDIX SUBMITTED ON A COMPACT DISC AND INCORPORATION-BY-REFERENCE OF THE MATERIAL

Not Applicable.

COPYRIGHT NOTICE

Not Applicable

BACKGROUND OF THE INVENTION

Field of the Invention

The present invention relates to a hybrid plectrum for plucking and strumming strings on musical instruments. More particularly, the invention relates to a hybrid plectrum having a bottom plucking region and a second material protruding from the top of the pick for actuating strings to provide alternate sounds.

Description of the Related Art

Plectra for plucking or otherwise impinging strings of musical instruments have existed for as long as there have been stringed instruments. They take many forms, but the most common are relatively flat and have a shape that approximates a Reuleaux triangle. Plectra are manufactured from an almost endless number of materials including turtle shells, seashells, plastics, stones, bones and metals. Each of these materials provide plectra having unique structural and audio features.

In addition to plectra, several other devices of been developed for impinging on or manipulating the strings of a stringed instrument that produce different sounds and/or transitions between notes. For example, tubes of brass or other material are placed over one or more fingers and slide along the strings to produce a glissando. Other sound effects may be produced by plucking strings with a finger, tapping, and dotting using fingers or other objects. Dotting is a technique that uses a tapping motion with one's fingers on the strumming hand to press against the guitar strings against the neck of the guitar. It is sometimes desirable to use two or more of these techniques during a single song. However, this can be difficult because it requires a musician to switch between two or more plectra, slides or other devices.

Plectra have been developed that have corners of different thicknesses. A musician can rotate the plectra between his or her fingers relatively quickly to pluck the strings with material of different thickness. Other plectra exist that allow a musician to adjust the flexibility of the plucking bottom region of a plectrum by adjusting his or her grip in the Central gripping region of a plectrum. However, these modifications provide relatively little variety in the types of sounds that may be created.

The above-described deficiencies of today's systems are merely intended to provide an overview of some of the problems of conventional systems, and are not intended to be exhaustive. Other problems with the state of the art and corresponding benefits of some of the various non-limiting embodiments may become further apparent upon review of the following detailed description.

In view of the foregoing, it is desirable to provide a single plectrum that allows a musician to create different sounds while providing a better grip.

BRIEF SUMMARY OF THE INVENTION

Disclosed is a plectrum for playing a stringed musical instrument includes a body with two opposing sides, a lower plucking region, a central gripping region and a top region having a transverse groove. A wedge shaped piece of material is secured into the transverse groove on the top of the plectrum to provide a second surface for impinging or actuating the strings of the instrument. Typically, the body of the plectrum is composed of a semi rigid or flexible plastic, while the wedge of material is composed of a harder substance, such as glass, polished stone or metal.

In one embodiment, A hybrid plectrum for use with stringed instruments comprises a body comprised of a first material, having two opposing sides, an oblong top region, a central gripping region and a bottom plucking region. A transverse wedge shaped groove extending downward from the oblong top and between the two opposing sides to a joint where the opposing sides meet. A wedge of a second material secured within the groove and having a top that extends above the oblong top region of the body.

The hybrid plectrum may optionally include a wedge having symmetric opposing sides, each of the opposing sides having a concavities corresponding to the central gripping region of the body of the plectrum. The central gripping region of the body may be comprised of a pliant material that depresses into the concavities of the wedge when the plectrum is gripped by a thumb and forefinger.

In another embodiment, a hybrid plectrum includes a wedge that is removably secured within the groove by two opposing barbs extending inward from two inside walls of the groove and engaging two complimentary slots on opposing sides of the wedge. The first material is selected from the group consisting of celluloid, nylon, acetyl, polyetherimide, polycarbonate, and acrylic. The second material is selected from rubber, wood, metal, glass, and stone. The wedge of the hybrid plectrum may have a curved top, or a planar top.

It is therefore an object of the present invention to provide a hybrid plectrum that provides a musician with multiple surfaces with which to actuate the strings of a stringed musical instrument.

These and other objects and advantages of the present invention will become apparent from a reading of the attached specification and appended claims. There has thus been outlined, rather broadly, the more important features of the invention in order that the detailed description thereof that follows may be better understood, and in order that the present contribution to the art may be better appreciated. There are features of the invention that will be described hereinafter and which will form the subject matter of the claims appended hereto.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION

Figure 1:
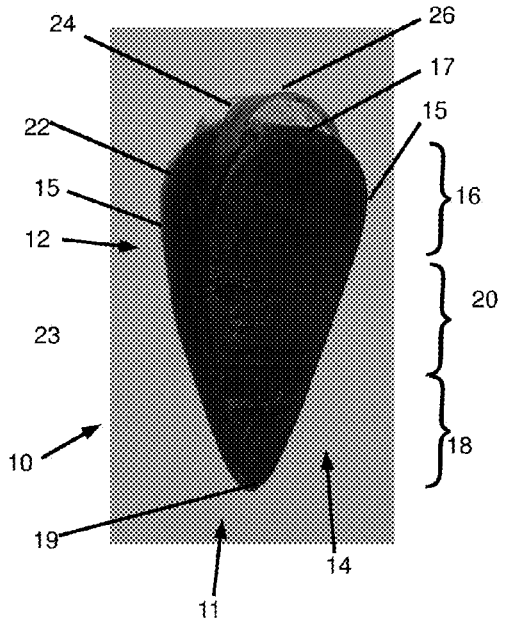
FIG. 1 is a perspective view of a hybrid plectrum in accordance with the principles of the invention.

The invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

The disclosed subject matter is described with reference to the drawings, wherein like reference numerals are used to refer to like elements throughout. In the following description, for purposes of explanation, numerous specific details are set forth in order to provide a thorough understanding of the various embodiments of the subject disclosure. It may be evident, however, that the disclosed subject matter may be practiced without these specific details. In other instances, well-known structures and devices are shown in block diagram form in order to facilitate describing the various embodiments herein.

In addition, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. Moreover, articles "a" and "an" as used in the subject specification and annexed drawings should generally be construed to mean "one or more" unless specified otherwise or clear from context to be directed to a singular form.

As used herein, the "top" of a plectrum generally refers to the wider part of an approximately triangular plectrum. The "bottom" of a plectrum generally refers to the lower corner commonly used for plucking strings of a stringed instrument. "Length" generally refers to the distance from the top to the bottom. "Transverse" generally refers to a plectrum's width, and "depth" or "thickness" refers to a plectrum's thickness. As used herein, the plectrum refers generally to a device used for plucking or otherwise actuating strings on a musical instrument, often referred to as a guitar pick.

Disclosed is a plectrum for playing a stringed musical instrument includes a body with two opposing sides, a lower plucking region, a central gripping region and a top region having a transverse groove. A wedge shaped piece of material is secured into the transverse groove on the top of the plectrum to provide a second surface for impinging or actuating the strings of the instrument. Typically, the body of the plectrum is composed of a semi rigid or flexible plastic, while the wedge of material is composed of a harder substance, such as glass, polished stone or metal.

Figure 2:
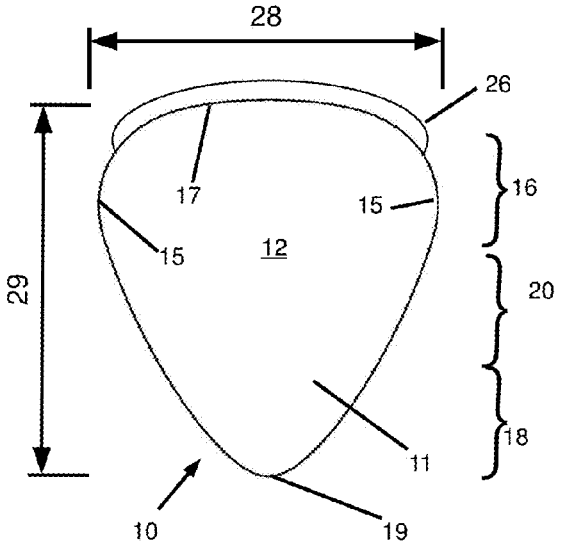
FIG. 2 is a front plan view of a hybrid plectrum in accordance with the principles of the invention.
Figure 3:
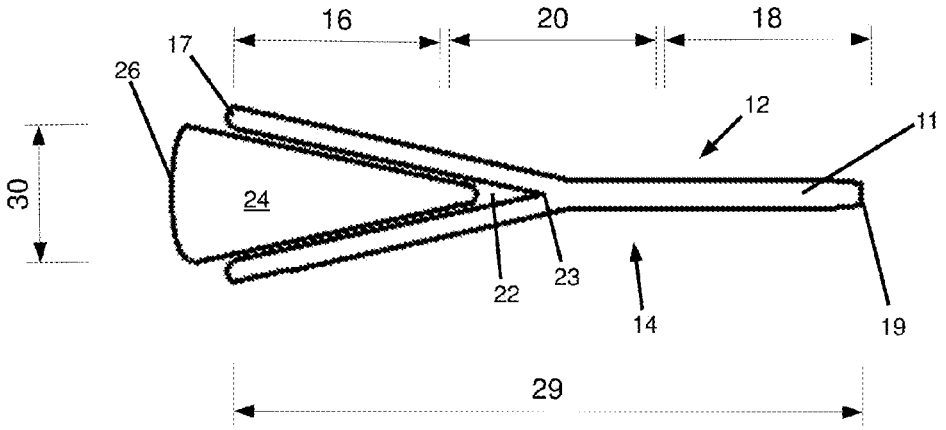
FIG. 3 is a side cross-sectional view of a hybrid plectrum in accordance with the principles of the invention.

FIGS. 1, 2 and 3 show a hybrid plectrum 10 in accordance with the principles of the invention. The plectrum 10 has a wide, flat body 11 which includes two opposing sides 12 and 14. The top region 16 of the plectrum 10 is oblong and has a slightly curved upper surface 17. A bottom region 18 is generally used for plucking the strings of a musical instrument, and ends in a blunt point 19. The central region 20 of the plectrum 10 is generally gripped between the thumb and forefinger on each of the opposing sides 12 and 14. A V-shaped groove 22 extends from the oblong top 17 to about half way down the length 29 of the plectrum 10, ending at the bottom, or junction, 23. The groove 22 extends transversely between the lateral edges 15, and separates the upper portions of the two opposing sides 12 and 14 of the body 11. The bottom 23 of the groove is the junction of the two opposing sides. The groove 22 and the junction 23 give the plectrum 10 a Y shaped cross-section. In this embodiment, the groove 22 extends downward entirely through the top region 16 and partially into the Central gripping region 20.

A wedge 24 is secured inside the groove 22. The top 26 of the wedge 24 extends upward from the groove and at least partially beyond the top 17 of the plectrum 10. The top 26 of the wedge 24 is slightly curved along both its width 28 and its depth 30.

In use, a musician grasps the plectrum 10 by holding it between his or her thumb and forefinger, which are position on opposing sides of the central gripping region 20. The bottom region 18 is used to pluck the strings of an instrument. At any point, the musician may rotate the plectrum 10 about the center gripping region 20 while still holding it with his or her thumb and forefinger. Thus, a musician can switch from plucking strings with the bottom region 18 two tapping, dotting and/or sliding on the strings with the top 26 of the wedge 24.

Typically, the plectrum is made of any material commonly used for manufacturing guitar picks including, for example, turtle shells, seashells, glass, plastics, stone, metals or other types of plastics or rigid materials. The wedge 24 is made of a different material, which may or may not be turtle shells, seashells, class, plastics, stone, metals or other types of plastics or rigid materials. For example, a thin flexible plastic may be used to form the body 11, thereby providing a flexible plucking region 18, and the wedge 24 may be comprised of glass which is much more rigid and is generally preferred for tapping or sliding the strings.

In this embodiment, the plectrum 10 is composed of polyoxymethylene and the wedge 24 is composed of glass. The top 26 of the wedge 24 extends between one and 3 mm above the top 17 of the plectrum 10, and the top 26 has a depth 30 ranging between 0.25 cm two 0.75 cm. The wedge 24 may be secured inside groove 22 using glue, an adhesive, molding the body 11 of the plectrum 10 onto the wedge, melting the plastic of body 11 inside the groove so that it is essentially welded onto the glass wedge 24 or other methods known in the art.

Figure 4:
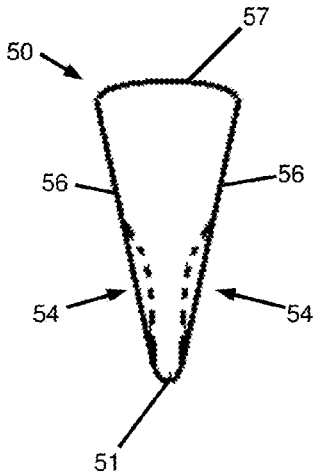
FIG. 4 is a side elevation view of a wedge of an alternative embodiment of a hybrid plectrum in accordance with the principles of the invention.
Figure 5:
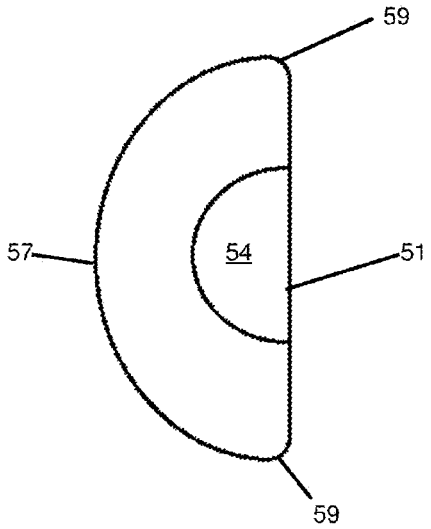
FIG. 5 is a front elevation view of a wedge of an alternative embodiment of a hybrid plectrum in accordance with the principles of the invention.
Figure 6:
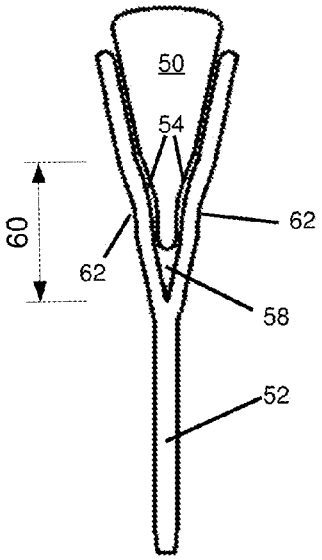
FIG. 6 is a cross-sectional side view of an alternative embodiment of a hybrid plectrum in accordance with the principles of the invention.

FIGS. 4, 5 and 6 show an alternative embodiment of a wedge 50 for a hybrid plectrum 52 in accordance with the principles of the invention. In this embodiment, the wedge 50 has two concave depressions 54 on each of its opposing sides 56. The concave depressions 54 are semicircular and extend from the bottom edge 51 upward to a point about halfway between the bottom 51 in the top 57. The wedge 50 has a top 57 that curves between the two lateral ends 59. The top of wedge 50 has a smaller radius of curvature in the transverse direction than the wedge 24 of FIGS. 1-3. Thus, the top 57 of wedge 50 curves almost 180° as it extends transversely between the two lateral ends 59. When the wedge 50 is inserted into the groove 58 of the hybrid plectrum 52, the concave depressions 54 are positioned in the opposing gripping region 60 of the hybrid plectrum 52. The gripping region 60 of the body 51 of plectrum 50 of this embodiment is pliant. When the plectrum 52 is grasped by a musician's thumb and forefinger, the opposing gripping region 60 are depressed into the depressions 54 of the wedge 50, creating concavities 62 in the gripping region 60. This gives a musician a stronger grasp of the plectrum 52, allowing a musician to hold it securely even when his or her hands or sweaty. The opposing gripping region 60 may also optionally include a textured surface such as for example ribs or knurls to further improve the gripping of the plectrum 52.

Figure 7:
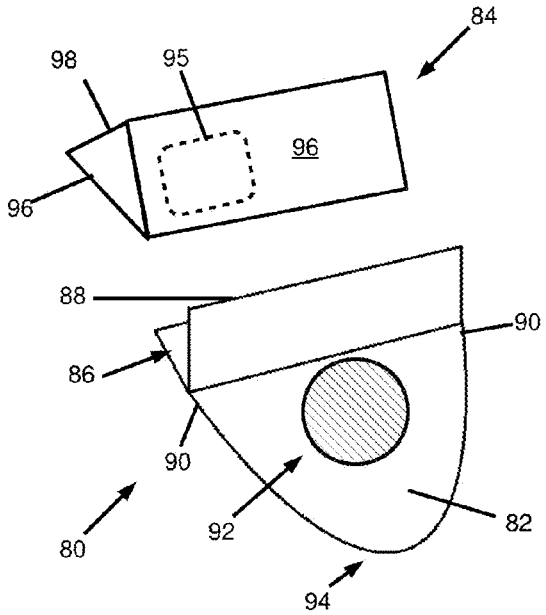
FIG. 7 is a perspective exploded view of another alternative embodiment of a hybrid plectrum in accordance with the principles of the invention.

FIG. 7 shows another alternative embodiment of a plectrum 80 having a body 82 and a wedge 84. The body 82 has a groove 86 extending across its top 88 transversely between lateral sides 90. The body includes a central gripping region 92 having a textured surface and a bottom picking region 94 for plucking strings on a musical instrument. In this embodiment, the top 88 of the body 82 is straight, not curved. The wedge 84 has two opposing rectangular sides 96 and a rectangular top 98.

The wedge 84 of this embodiment also includes an internal electric module 95. Pickups used in electric guitars pickup disturbances in a magnetic field caused by a vibrating string. Generally, interfering with the magnetic field is considered detrimental to the quality of the music. However, the electric module 95 in the wedge 84 is specifically designed to interfere with a pickups magnetic fields. The electric module 95 may be a transducer, a simple coil, a modulating capacitor or other electronic device capable of influencing a proximate magnetic field. This allows the plectrum 82 generate additional unique sounds when actuated, i.e. called upon. The electric module 95 may be adjusted or triggered using an app on a smart phone via Bluetooth® or other transmission technology, such as a USB port. The electric module 95 may also optionally be adjusted by squeezing the plectrum 80 during use. In this embodiment, the wedge 84 is comprised of a semi-rigid material so that it may be squeezed, thereby triggering the electric module 95 to alter the magnetic field proximate to an electric guitar pickup.

Figure 8:
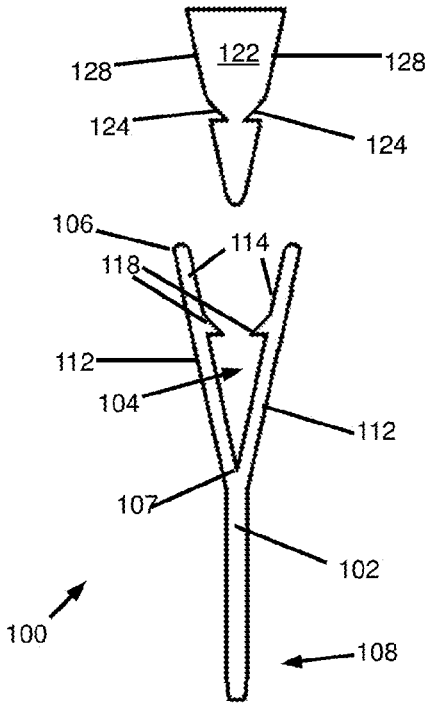
FIG. 8 is a side cross-sectional exploded view of another alternative embodiment of a hybrid plectrum in accordance with the principles of the invention.
Figure 9:
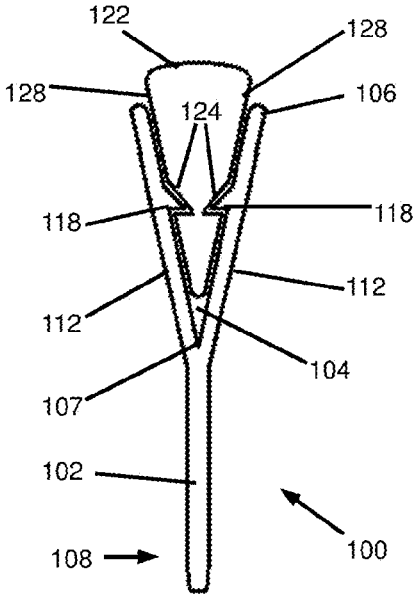
FIG. 9 is a side cross-sectional view of an assembled other alternative embodiment of a hybrid plectrum in accordance with the principles of the invention.

FIGS. 8 and 9 show another alternative embodiment of a hybrid plectrum 100 in accordance with the principles of the invention. The plectrum 100 has a body 102 having a groove 104 extending from the top 106 of the plectrum 100, and a bottom plucking region 108. The groove 104 extends from the top 106 to a joint 107 between symmetric opposing sides 112. In this embodiment, the inside walls 114 of the groove 104 includes inward pointing two barbs 118. The wedge 122 has two complementary sockets 124 on both of its symmetric opposing sides 128. When the wedge 122 is pushed into the groove 104, the barbs 118 engage the sockets 124, thereby securing the wedge 122 in place. The wedge 122 may be removed by pulling apart the opposing sides 112 near the top 106 of the plectrum 100, which disengages the barbs 118 from the sockets 124, allowing the wedge 122 to be withdrawn from the groove 104.

Figure 10:
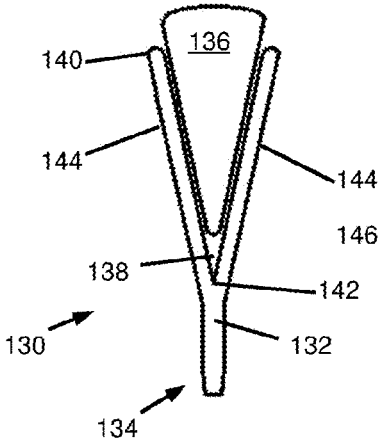
FIG. 10 is a side cross-sectional view of another alternative embodiment of a hybrid plectrum in accordance with the principles of the invention.

FIG. 10 shows another alternative embodiment of a hybrid plectrum 130 in accordance with the principles of the invention. Plectrum 130 has a body 132 with a Y shaped cross-section, a bottom plucking region 134 and a wedge 136 inside a groove 138 extending downward from the top 140 of the plectrum 130 to a joint 142 where the opposing sides 144 meet. In this embodiments, the groove 138 and wedge 136 extend more than half way down the length of the body 132, and the central gripping region 146 is above the joint 142.

Figure 11:
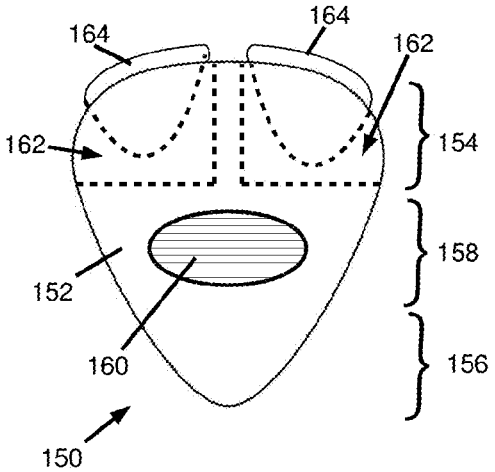
FIG. 11 is a front plan view of another alternative embodiment of a hybrid plectrum in accordance with the principles of the invention.

FIG. 11 shows another alternative embodiment of a hybrid plectrum 150 in accordance with the principles of the invention. Plectrum 150 has a body 152 having a shape roughly approximating a Reuleaux triangle, having an oblong top region 154, a bottom plucking region 156 and a central gripping region 158. The central gripping region 158 includes a striated pad 160 having a plurality of small ribs to assist in gripping the plectrum 150. The oblong top region includes two separate pockets 162, each pocket containing a wedge 164 of a different material. The wedges 164 may be retained within the pockets 162 using glue, an adhesive, complementary barbs and sockets or other mechanisms known in the art. Because each of the wedges 164 may be comprised of a different material, each wedge 164 provides a musician with different options for generating sound from a strained musical instrument.

Whereas, the present invention has been described in relation to the drawings attached hereto, it should be understood that other and further modifications, apart from those shown or suggested herein, may be made within the spirit and scope of this invention. Descriptions of the embodiments shown in the drawings should not be construed as limiting or defining the ordinary and plain meanings of the terms of the claims unless such is explicitly indicated.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The invention claimed is:

1. A plectrum for use with stringed instruments comprising:

a body comprised of a first material, having two opposing sides, an oblong top region, a central gripping region and a bottom plucking region;

a transverse wedge shaped groove extending downward from the oblong top and between the two opposing sides to a transverse joint where the opposing sides meet, wherein the transverse joint is located between the oblong top region and the bottom plucking region;

a wedge of a second material secured within the groove and having a top that extends above the oblong top region of the body.

2. The plectrum of claim 1 wherein the wedge has symmetric opposing sides, each of the opposing sides having a concavities corresponding to the central gripping region of the body of the plectrum; and, wherein the central gripping region of the body is comprised of a pliant material that depresses into the concavities of the wedge when the plectrum is gripped by a thumb and forefinger.

3. A plectrum for use with stringed instruments comprising:

a body comprised of a first material, having two opposing sides, an oblong top region, a central gripping region and a bottom plucking region;

a transverse wedge shaped groove extending downward from the oblong top and between the two opposing sides to a joint where the opposing sides meet;

a wedge of a second material secured within the groove and having a top that extends above the oblong top region of the body;

wherein the wedge is removably secured within the groove by two opposing barbs extending inward from two inside walls of the groove and engaging two complimentary slots on opposing sides of the wedge.

4. A plectrum for use with stringed instruments comprising:

a body comprised of a first material, having two opposing sides, an oblong top region, a central gripping region and a bottom plucking region;

a transverse wedge shaped groove extending downward from the oblong top and between the two opposing sides to a joint where the opposing sides meet;

a wedge of a second material secured within the groove and having a top that extends above the oblong top region of the body;

wherein the first material is selected from the group consisting of celluloid, nylon, acetyl, polyetherimide, polycarbonate, and acrylic; and, wherein the second material is selected from rubber, wood, metal, glass, and stone.

5. The plectrum of claim 1 wherein the wedge has a curved top.

6. The plectrum of claim 1 wherein the wedge has a planar top.

* * * * *